US008444297B2

(12) United States Patent
Lee et al.

(10) Patent No.: US 8,444,297 B2
(45) Date of Patent: May 21, 2013

(54) LIGHTING APPARATUS USING LIGHT-EMITTING DIODE

(75) Inventors: Jae Yeong Lee, Seoul (KR); Sang Dong Jeong, Incheon (KR)

(73) Assignee: Amoluxe Co., Ltd. (KR)

( * ) Notice: Subject to any disclaimer, the term of this patent is extended or adjusted under 35 U.S.C. 154(b) by 204 days.

(21) Appl. No.: 13/173,354

(22) Filed: Jun. 30, 2011

(65) Prior Publication Data

US 2011/0261567 A1 Oct. 27, 2011

Related U.S. Application Data

(63) Continuation-in-part of application No. PCT/KR2009/007901, filed on Dec. 29, 2009.

(30) Foreign Application Priority Data

Jan. 12, 2009 (KR) ..... 10-2009-0002181

(51) Int. Cl.
*F21S 4/00* (2006.01)
*F21V 21/00* (2006.01)

(52) U.S. Cl.
USPC ..... 362/249.02; 362/294; 362/373; 362/431; 362/800

(58) Field of Classification Search ..... 362/249.02, 362/294, 373, 431, 800
See application file for complete search history.

(56) References Cited

U.S. PATENT DOCUMENTS

2006/0012286 A1 1/2006 Cull et al.

FOREIGN PATENT DOCUMENTS

JP 2007-095647 4/2007
JP 2007-122936 5/2007

OTHER PUBLICATIONS

International Search Report—PCT/KR2009/007901 dated Aug. 13, 2010.

*Primary Examiner* — Jason Moon Han
(74) *Attorney, Agent, or Firm* — Cantor Colburn LLP

(57) ABSTRACT

Disclosed is a lighting apparatus using light-emitting diodes. The lighting apparatus includes: a housing in which an inner side surface is partitioned into a plurality of mounting surfaces and a plurality of cooling fins is prominently formed on an outer side surface; a plurality of light source blocks provided with a plurality of LED modules on an outer surface of a plurality of angle adjusting blocks having multi-step inclined surfaces, and mounted at positions selectively determined on the plurality of mounting surfaces of the housing so that light emitted from the LED modules can implement a predetermined light distribution type; and a protection cover for covering a lower portion of the housing.

13 Claims, 8 Drawing Sheets

(a): First light distribution type (b): Second light distribution type (c): Third light distribution type (d): Fourth light distribution type (e): Fifth light distribution type

LIGHTING APPARATUS USING LIGHT-EMITTING DIODE

TECHNICAL FIELD

The present invention relates to a lighting apparatus using light-emitting diodes, and particularly, to a lighting apparatus using light-emitting diodes, in which a wide area of a road can be illuminated although the light-emitting diodes are used as a light source, and design of the lighting apparatus can be easily modified from a basic structure to have a variety of light distribution curves required for diverse illumination on the road.

BACKGROUND ART

Generally, street lamps are lighting facilities constructed along a street for traffic safety and security on the road, and a suitable type of street lamp is used depending on the places where the street lamps are installed, such as a highway, a main street in a city, a road in a commercial district, a road in a residential area, and the like.

The lighting apparatus includes a lamp housing provided with a reflecting plate on the inner side surface and installed on a street lamp pole, and a light source mounted inside the lamp housing and emitting light. There are various types of street lamp poles, such as a highway type in which the top portion of a pole is bent and a lamp is attached at the end point, a bracket type in which branches are extended from the top of a pole and a lamp is attached at the end of each branch, and a pole-head type in which a lamp is attached on the top of a pole.

In addition, a high pressure mercury lamp, a fluorescent lamp, a natrium lamp, a general electric lamp, or the like is used as the light source. The street lamp emits white, yellow, or blue light by the light source of a predetermined color. It is apparent that the street lamp can be selected based on efficiency of power, intensity of light, or atmosphere of surrounding areas.

On the other hand, when the street lamps are installed on the road, light distribution for distributing light on the road is designed to illuminate the road most efficiently, and when bulb-type lamps are used, illumination of the road is designed to illuminate the road with proper light distribution by adjusting a reflecting angle of the reflecting plate provided on the inner side surface the lamp housing.

Generally, as shown in FIG. 10, light distribution mainly used for illuminating a road is divided into first to fifth light distribution types, and except some special cases, the second to fourth light distribution types are mainly used to efficiently illuminate most of the roads.

However, various types of lamps used as a light source in the conventional street lamps, such as a high pressure mercury lamp, a fluorescent lamp, a natrium lamp, and the like, are disadvantageous in that light intensity and diffusing range are predetermined when the lamps are initially manufactured and cannot be manually adjusted by a user. Furthermore, the lamps have a very short lifespan and consume a large amount of power.

Considering these problems, lighting apparatuses using light-emitting diodes (LED) as a light source are proposed recently. With the advancement of technologies, LEDs consuming a small amount of power and emitting light of high brightness are developed, and use of the LEDs tends to be gradually increased. Since light emitted from the high brightness LED has a high directionality, a lens unit (not shown) for scattering light emitted from the LED chip and classifying an irradiating range into a 12° lens, a 25° lens, a 30° lens, a 45° lens or the like is included when the LED chip is packaged in order to irradiate the high directional light on a wide area.

However, since the lighting apparatus using LEDs has a relatively small radiation angle compared with a bulb-type light source having a radiation angle of 360 degrees, it is general that a plurality of LED modules is mounted on the bottom surface of an upper plate unit of the housing and the lighting apparatus illuminates a road using the reflecting plate provided inside the side surface of the housing.

The lighting apparatus includes a plurality of LED modules on the bottom surface of the upper plate unit in order to secure a cut-off-angle so that a passenger or a driver cannot directly see the LED modules within a certain angle.

However, since street lamps using the high brightness LEDs may hinder walking or driving and cause safety accidents if a pedestrian or a driver directly sees the light emitted from the light source while walking or driving, securing the cut-off-angle is necessarily needed.

However, although the LED has a long lifespan as long as to say semi-permanent compared with conventional lamps, brightness of the LED is determined by combination of a plurality of LEDs. Therefore, if light distribution is formed using the reflecting plate, a light distribution area is small, and brightness of the light is low. Furthermore, there is a limit in forming light distribution that can efficiently illuminate road surfaces, i.e., in forming light distribution of the first to fifth light distribution types. Accordingly, an ideal array is excluded when the lighting apparatus using LEDs is manufactured, and brightness is provided depending only on the reflecting plate, and thus the lighting apparatus is not widely used since illumination on the road is inefficient.

Furthermore, since it is difficult to efficiently dissipate the heat emitted from the plurality of LEDs, light emitting efficiency is lowered due to the heat, and components of the lighting apparatus can be easily damaged.

In addition, conventional street lamps using LEDS or general street lamps use a transparent protection cover in order to protect lamps installed inside the housing. However, since the protection cover is mainly formed as a concave type protruding toward outside of the housing, a street lamp is formed in a shape protruding upward and downward, and overall volume of the lamp increases when the housing is coupled with the protection cover, and thus it is inconvenient to store and carry the lamp.

Furthermore, fixing pieces are used to mount the LED modules inside the housing, and connection holes are formed inside the housing at this point in order to attach the fixing pieces to the housing. However, a portion of the housing where the connection holes are formed should be thicker than the other portions of the housing, and thus weight of the housing increases. Accordingly, workers should make a lot of efforts with a great force when installing the street lamp on the pole, and thus it is difficult to install the street lamp. In addition, since the surface area of cooling fins formed on the thick portion of the housing is relatively smaller than that of the cooling fins formed on the thin portions, overall cooling efficiency is lowered.

Furthermore, if rainfalls infiltrate into the housing due to a poor waterproof structure between the housing and the protection cover, a lamp installed inside the housing or electronic elements installed on a printed circuit board are affected by the rainfalls, which causes malfunctions of the street lamps.

SUMMARY OF THE INVENTION

Therefore, the present invention has been made in view of the above problems, and it is an object of the present invention to provide a lighting apparatus using light-emitting diodes, in which a wide area of a road can be illuminated although the light-emitting diodes are used as a light source, and design of the lighting apparatus can be easily modified from a basic structure to have a variety of light distribution curves required for diverse illumination on the road.

Another object of the present invention is to provide a lighting apparatus using light-emitting diodes, in which a plurality of LED modules is selectively arranged, as point light sources, on the inner peripheral surface of the housing which has a symmetrical structure in the radial direction so that a desired light distribution type may be implemented, and thus characteristics of the desired light distribution type can be implemented.

Another object of the present invention is to provide a lighting apparatus using light-emitting diodes, which is provided with angle adjusting blocks that can easily receive a plurality of wires for a plurality of LED modules while forming a desired radiation angle when a plurality of light source blocks installed with the plurality of LED modules is installed on the inner peripheral surface of the housing.

Another object of the present invention is to provide a lighting apparatus using light-emitting diodes, which can be easily assembled.

To accomplish the above object, according to one aspect of the present invention, there is provided a lighting apparatus using light-emitting diodes, comprising: a housing having an open bottom and provided with a receiving concave whose diameter increases toward the lower portion, in which the inner side surface of the receiving concave is partitioned into a plurality of mounting surfaces, and a plurality of cooling fins is predominantly formed on the outer side surface in a radial shape to be spaced at regular intervals; a plurality of light source blocks mounted along the mounting surface on the inner side of the housing, provided with a plurality of LED modules installed on the outer surface of a plurality of angle adjusting blocks having multi-step inclined surfaces, set to different radiation angles and brightness, and mounted at positions selectively determined on the plurality of mounting surfaces so that light emitted from the LED modules can implement a predetermined light distribution type; and a protection cover for covering a lower portion of the housing.

The housing may be formed to be thin and uniform in thickness in order to expand the surface area of the cooling fins. In addition, the horizontal cross section of the housing may be formed in any one of shapes including a circle, an oval, a rectangle, a square, and a polygon.

The angle adjusting block preferably includes: a penetrating hole for guiding a wire drawn out from the LED module to the rear side to pass through the angle adjusting block; and a duct unit extendedly formed at one side of the angle adjusting block, one end of which is communicated with the penetrating hole, for guiding the wire to a printed circuit board. Accordingly, since wires in the housing can be put in order, delay of work caused by wiring can be prevented when maintenance is performed.

In addition, the plurality of cooling fins is formed to have a thick cooling fin at regular intervals, and connection holes for receiving fixing pieces are preferably formed on the inner side of the relatively thick cooling fin among the plurality of cooling fins in order to fix the angle adjusting block. In this case, the housing is preferably formed to be thin and uniform in thickness in order to expand the surface area of the cooling fins. Accordingly, overall weight of the housing can be reduced, and cooling efficiency of the cooling fins can be improved.

Furthermore, the protection cover includes a convex portion slowly depressed toward inside the housing as it approaches to the center in order to minimize total reflection of light emitted from the LEDs. Accordingly, overall volume of the lighting apparatus is reduced, and thus it is easy to store and carry the lighting apparatus.

In addition, the lighting apparatus further comprises a fixing ring for fixedly supporting the protection cover to the housing; and a packing unit installed along the outer circumference of the protection cover, for protecting water between the protection cover and the housing. The packing unit is preferably provided with a plurality of sealing projections along the outer circumference of the packing unit.

The lighting apparatus further comprises: a printed circuit board mounted to be spaced apart from the inner top surface of the housing, for supplying power to the LEDs. The printed circuit board is a double side printed circuit board, in which electronic elements are installed on the top surface, and an amber LED module is installed on the bottom surface.

It is preferable that a power element installed on the printed circuit board is supported by a spacer arranged between the power element and the top surface of the printed circuit board and contacts with the inner top surface of the housing, in order to dissipate heat.

According to another aspect of the present invention, there is provided a lighting apparatus using light-emitting diodes, comprising: a housing having an open bottom and provided with a receiving concave, in which the inner side surface of the receiving concave is partitioned into a plurality of mounting surfaces, and a plurality of cooling fins is formed on the outer surface in a radial shape to be spaced at regular intervals; a plurality of light source blocks mounted along the mounting surface on the inner side of the housing, provided with a plurality of LED modules installed on the outer surface of a plurality of angle adjusting blocks, set to different radiation angles and brightness, and mounted at positions selectively determined on the plurality of mounting surfaces so that light emitted from the LED modules can implement a predetermined light distribution type; a printed circuit module installed to be spaced apart from the inner top surface of the housing, for supplying power to the LEDs; and a protection cover provided with a convex portion slowly depressed toward inside the housing as it approaches to the center in order to minimize total reflection of light emitted from the LEDs, for covering a lower portion of the housing.

The diameter of the outer side surface of the housing increases toward a low portion of the housing, and the housing is formed to have a uniform thickness, or the diameter of the outer side surface of the housing is set to be uniform. The mounting surface of the housing on which the plurality of angle adjusting blocks of the plurality of light source blocks is installed may be formed to have an inclination angle.

In this case, the angle adjusting block may include: at least one inclined surface for differentiating radiation angles when the LED modules are mounted; a penetrating hole for guiding a wire drawn out from the LED module to the rear side to pass through the angle adjusting block; and a duct unit extendedly formed on the top of the angle adjusting block, one end of which is communicated with the penetrating hole, for guiding the wire to a printed circuit board.

As described above, in the present invention, lighting apparatuses of various desired light distribution types can be easily implemented by combining a plurality of light source blocks having a plurality of LED modules in a variety of forms on an angle adjusting block which provides diverse angles inside the housing.

In addition, since each of wires drawn out from a plurality of LED modules passes through a duct unit of each angle adjusting block, the wires are prevented from being disorderly arranged inside the housing. Therefore, the plurality of wires is maintained to be orderly arranged, and thus efficiency of work can be improved when maintenance is performed.

Furthermore, workability can be enhanced when the lighting apparatus is installed on the pole by reducing weight of the housing, and at the same time, cooling efficiency can be improved by expanding the surface area of cooling fins formed on the housing.

In addition, overall volume can be reduced by depressing the protection cover toward inside at slow curvature, and thus it is easy to carry the lighting apparatus, and the lighting apparatus can be easily stored while the protection cover is assembled into the housing.

Furthermore, water can be prevented by a packing unit installed along the outer circumference of the protection cover, and particularly, sealing capability can be improved owing to a plurality of sealing projections formed on the packing unit.

DETAILED DESCRIPTION OF THE INVENTION

The configuration of a lighting apparatus using LEDs according to a preferred embodiment of the present invention will be hereinafter described in detail, with reference to the accompanying drawings.

Figure 1:
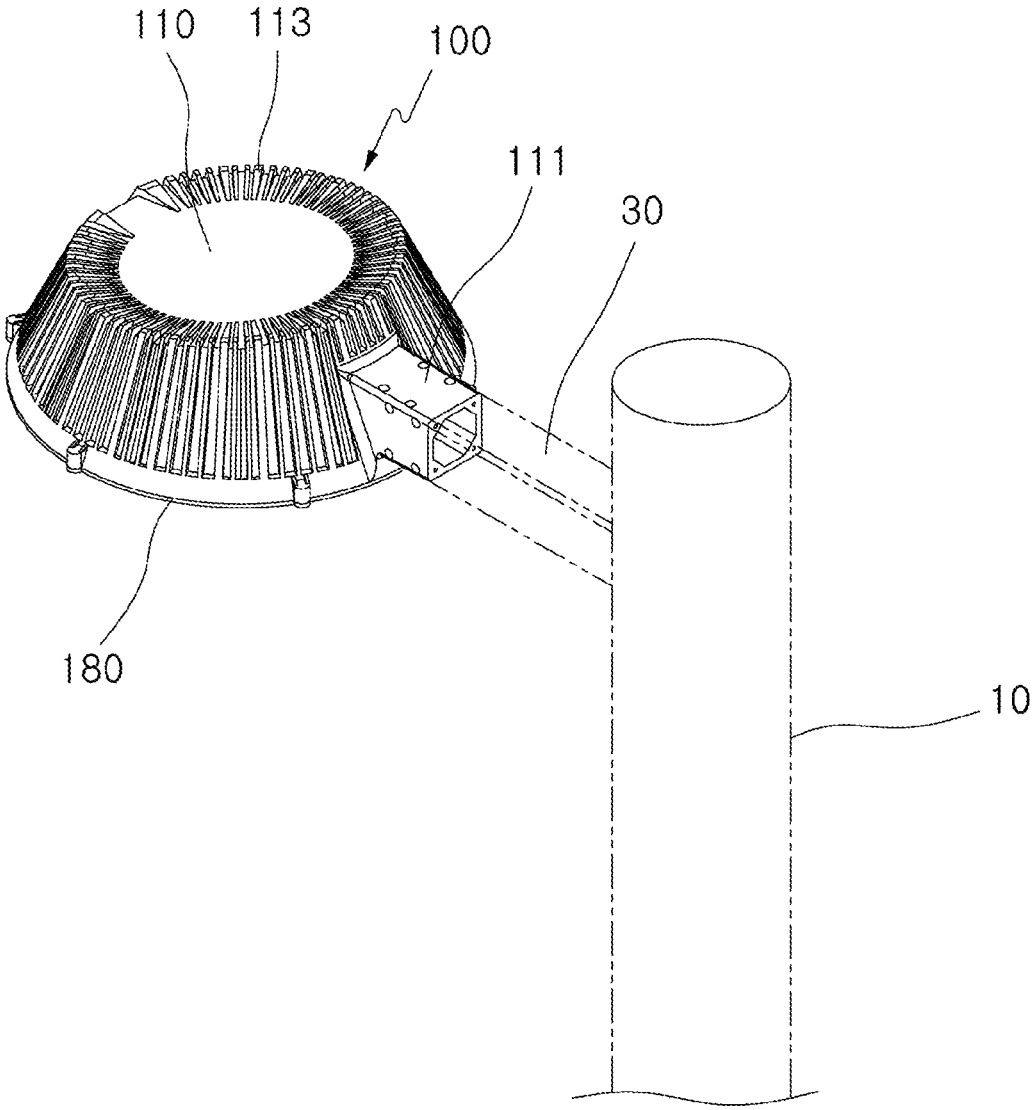
FIG. 1 is a perspective view showing a lighting apparatus using LEDs according to an embodiment of the present invention.

The lighting apparatus 100 using LEDs of the present embodiment can be fixedly installed at an arm 30 extended from one side of the top portion of the pole 10 as shown in FIG. 1 when the lighting apparatus is applied, for example, to a street lamp. However, the lighting apparatus 100 of the present invention can be applied to indoor or outdoor parking lots, indoor lightings, tunnels, and the like, in addition to the street lamps.

Figure 2:
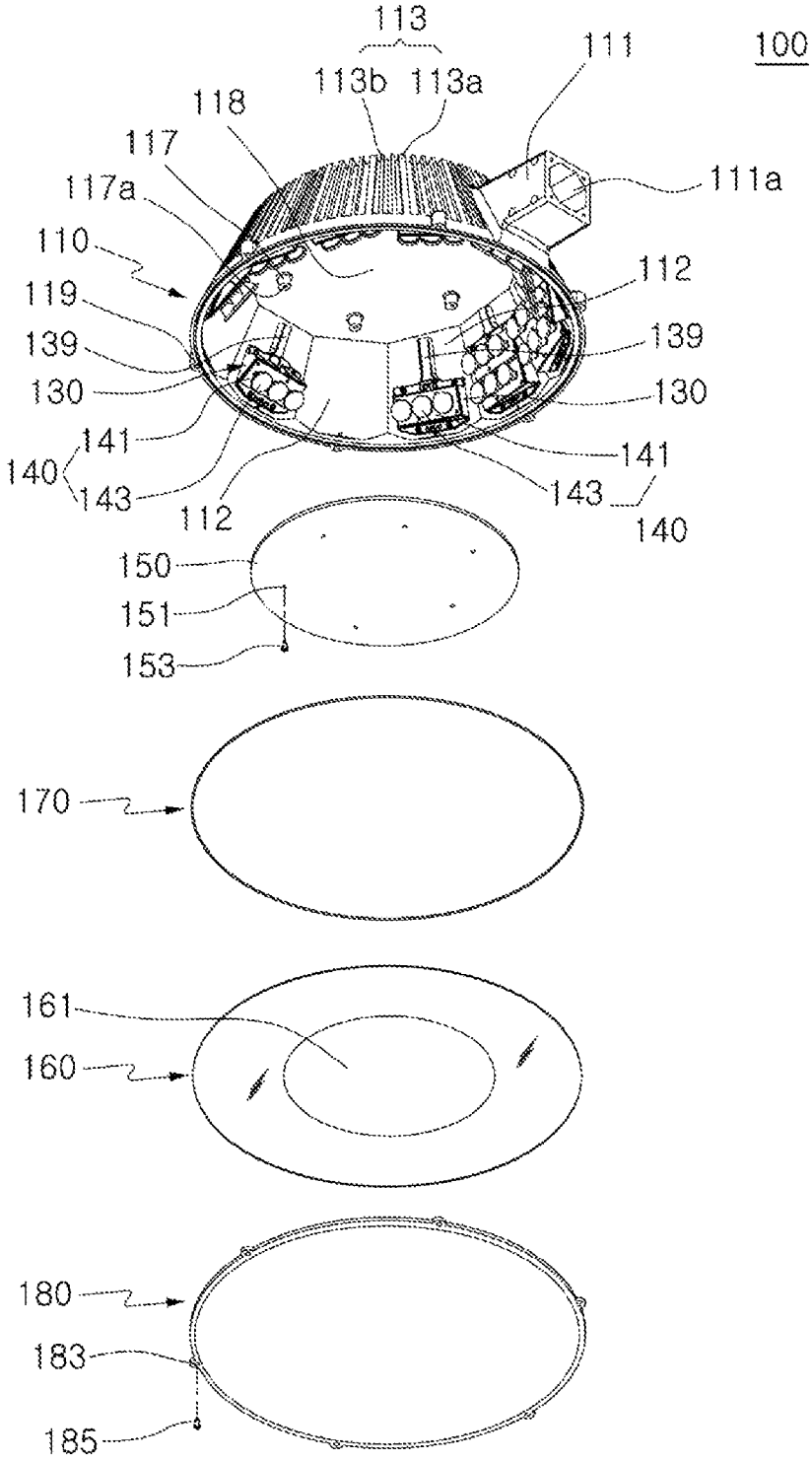
FIG. 2 is an exploded perspective view showing a lighting apparatus using LEDs according to an embodiment of the present invention.

Referring to FIG. 2, the lighting apparatus 100 includes a housing 110, a plurality of light source blocks 130 including a plurality of angle adjusting blocks 131 installed with a plurality of LED modules 140, a printed circuit board 150 (hereinafter, referred to as a PCB), a packing unit 160, a protection cover 170, and a fixing ring 180.

The bottom of the housing 110 is open for illumination. The housing 110 is formed of a metal having excellent heat conductivity, such as aluminum or aluminum alloy, considering heat transfer and hardness and can be manufactured in a pressure or die-casting method. A connection unit 111 is extendedly formed at one side of the housing 110 to be fixed to one end of the arm 30, and the connection unit 111 has a certain space unit 111*a* for passing through certain power wires and the like drawn out from inside of the housing 110 into the arm 30. The connection unit 111 can be diversely modified depending on the fields where the lighting apparatus 100 is applied.

Figure 3:
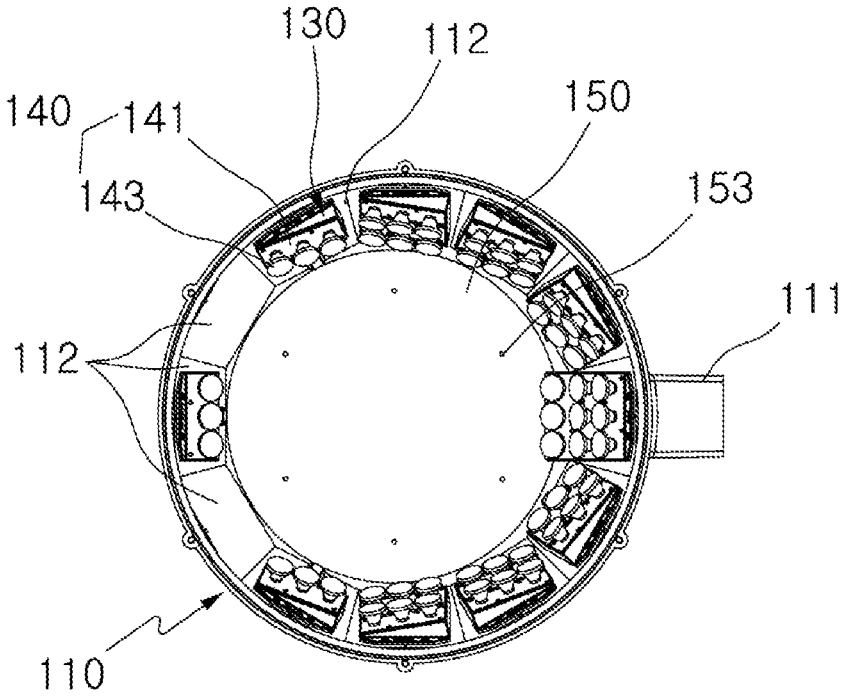
FIG. 3 is a view showing a lighting apparatus using LEDs from the bottom according to an embodiment of the present invention.
Figure 4:
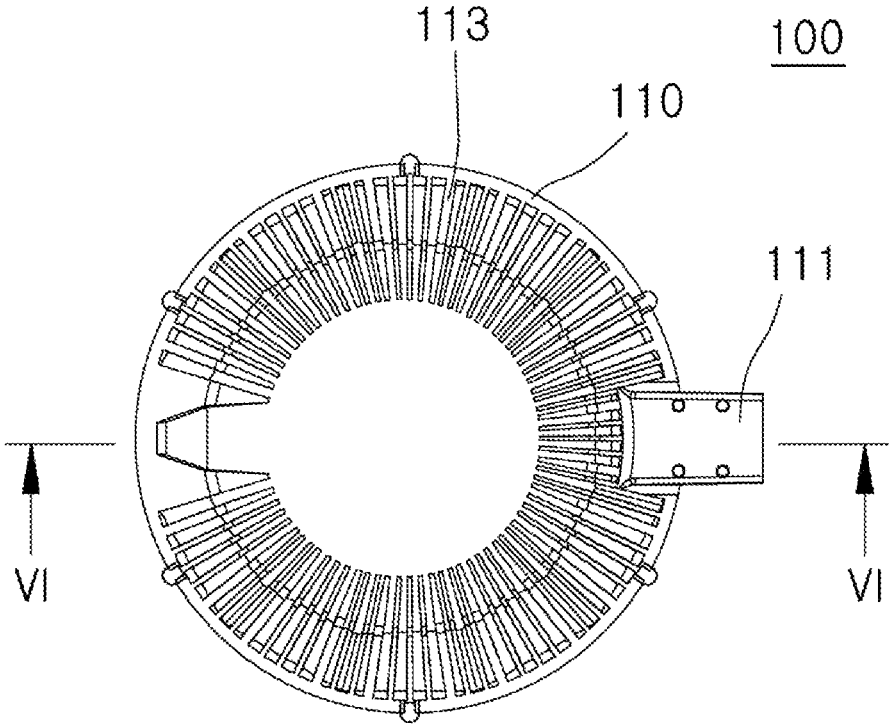
FIG. 4 is a plan view showing a lighting apparatus using LEDs according to an embodiment of the present invention.

Referring to FIGS. 3 and 4, the housing is provided with a receiving concave, in which the bottom is open and the diameter increases toward the lower portion. The inner side surface of the receiving concave is partitioned into a plurality of mounting surfaces 112, and a plurality of cooling fins 113 is prominently and vertically formed in a radial shape to be spaced at certain intervals on the outer surface of the housing 110. It is preferable to form the plurality of cooling fins 113 as one body from the side surface to the top surface of the housing 110 in order to increase the area contacting with outside, since cooling efficiency is improved thereby.

Although it is preferable that the external appearance of the housing 110 is formed in a shape of a circular truncated cone and the horizontal cross section is formed in a shape of a circle as shown in FIG. 1, the horizontal cross section may be formed in a shape of an oval, a square, a rectangle, or a polygon.

In addition, although the housing 110 is formed to have a diameter increasing downward and a side wall is formed to have a uniform thickness in the embodiment as an example, it is possible to implement the housing 110 to have a uniform diameter, and a plurality of mounting surfaces 112 formed in the receiving concave inside the housing may have an inclined surface.

A plurality of light source blocks 130 is fixed on the plurality of mounting surfaces 112 of the housing 110 in a radial shape. This will be described in detail below.

Figure 5:
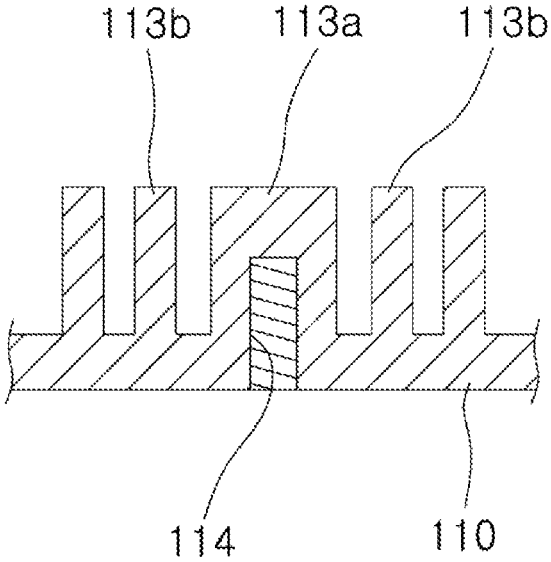
FIG. 5 is a cross-sectional view showing a plurality of cooling fins of different thickness.

Referring to FIGS. 1 and 5, some cooling fins 113 formed on the outer surface of the housing 110 are formed to be thicker than the other fins at regular intervals. That is, a thicker cooling fin 113*a* and a plurality of adjacent thinner cooling fins 113*b* are formed at regular intervals in a radial shape. In this case, connection holes 114 for receiving fixing pieces 132 (refer to FIG. 7) for fixing the angle adjusting blocks 131 on the mounting surface 112 are formed on the thicker cooling fin 113*a*. Accordingly, since the housing 110 and the cooling fins do not need to be formed thick overall in order to form the connection holes 114 in the housing 110 unlike conventional lighting apparatuses, a thin housing 110 with uniform thickness can be formed. Accordingly, in the present invention, the weight and size of the housing 110 can be reduced compared with conventional lighting apparatuses, and if the size of the housing 110 is the same as that of a conventional housing, the surface area of the cooling fins 113 is increased as much as the reduced thickness compared with the conventional one, and thus cooling efficiency can be improved.

Figure 6:
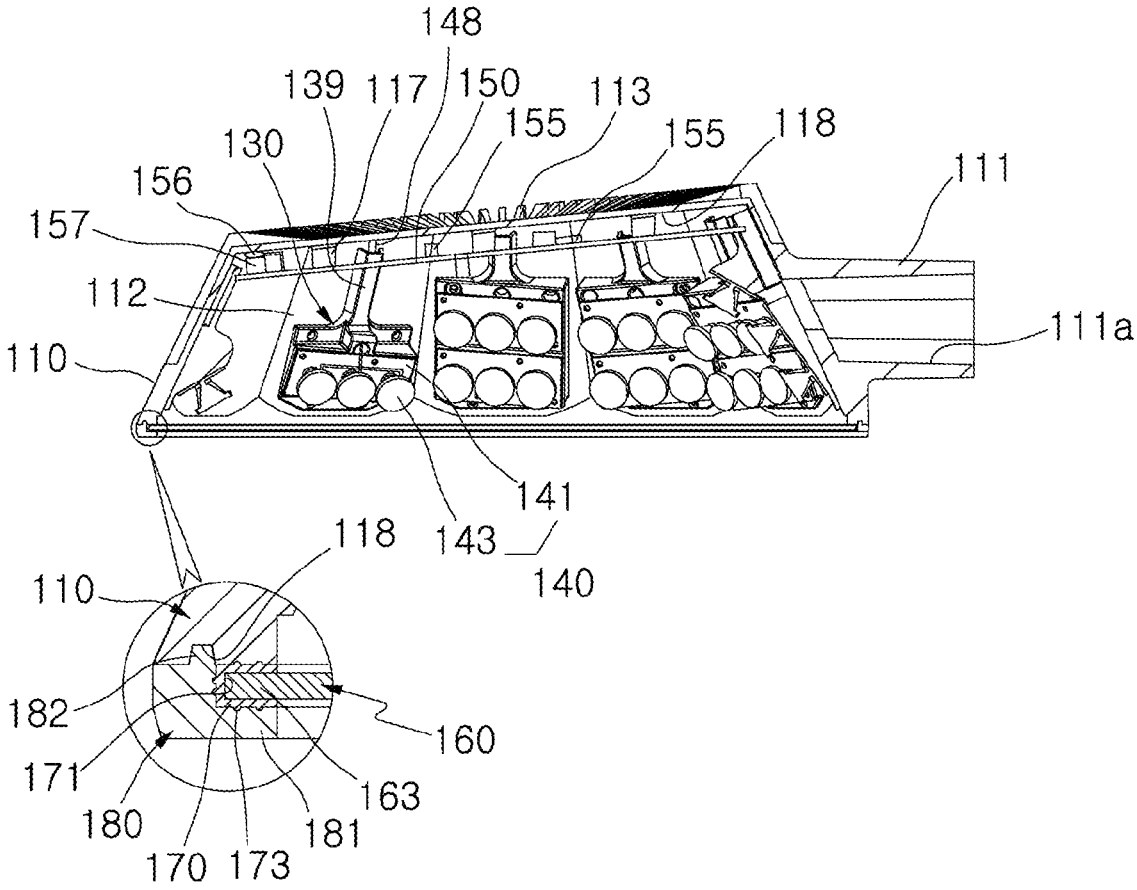
FIG. 6 is a cross-sectional view taken along the line VI-VI in FIG. 4.

Referring to FIGS. 2 and 6, a plurality of fixing projections 117 for fixing the PCB 150 installed with certain electronic elements 155 is form on the inner top surface 118 of the housing 110, and a connection hole 117*a* for receiving a fixing piece 153 is formed in the fixing projection 117. In this case, a plurality of penetrating holes 151 is formed in the PCB 150 at the positions corresponding to the plurality of fixing projections 117, and the PCB is fixed to the plurality of fixing projections 117 using a plurality of fixing pieces 153. At this point, the plurality of fixing projections 117 functions as a spacer to space the PCB 150 apart from the inner top surface 118 of the housing 110 so that high temperature heat generated by the plurality of LED modules 140 and transferred to the housing 110 may not damage the PCB 150 pattern or cause malfunctions of the electronic elements 155 installed on the PCB 150.

On the other hand, a double side PCB such as an FR4 can be used as the PCB 150, and a power circuit of a switching mode power supply (SMPS) method and a constant current/constant voltage circuit are provided on the PCB 150. In this case, a power element 156 installed on the PCB 150 is supported by a sponge 157 and contacts with the inner top surface 118 of the housing 110 in order to dissipate the heat. In addition, when a plurality of LEDs is associated on the PCB 150 in order to implement a color of the lighting apparatus 100, an amber LED module (not shown) can be installed on the bottom surface of the PCB 150 in combination with the plurality of LED modules 140 installed on the side surface of the receiving concave of the housing 110 in order to emit an amber color in addition to cool/white and warm/white colors.

Figure 7:
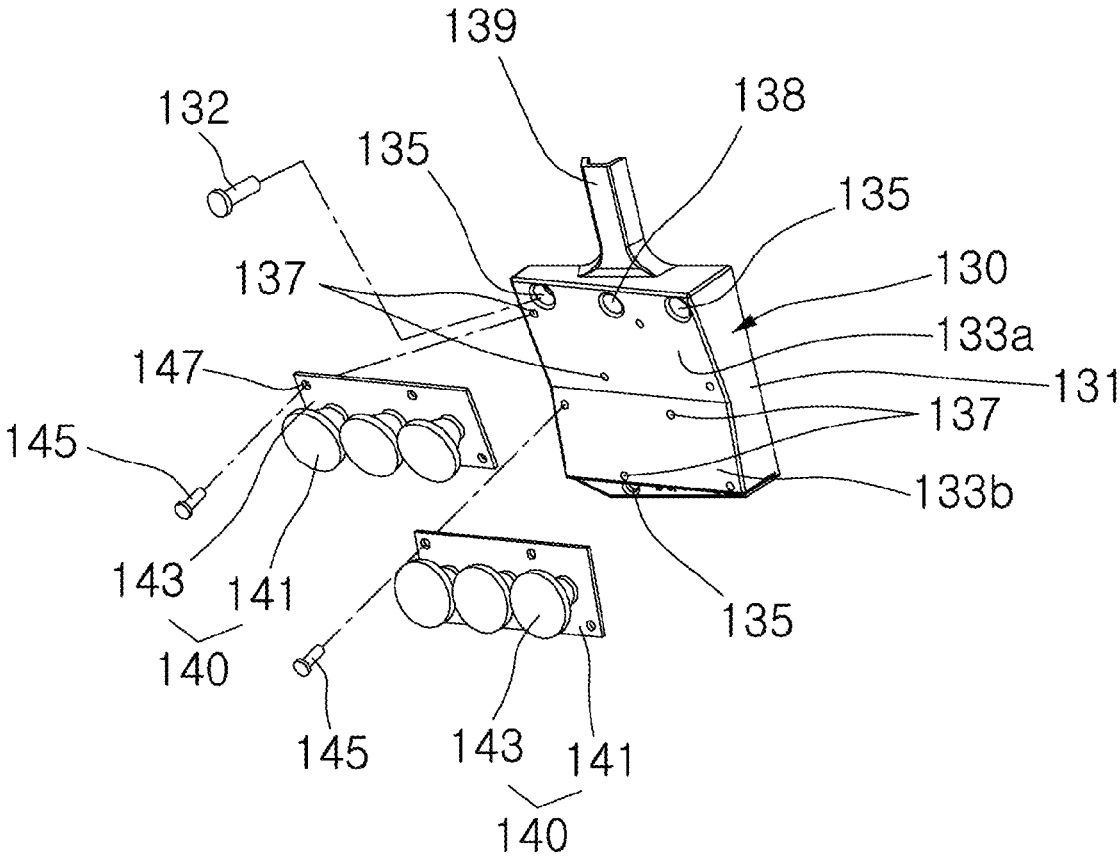
FIG. 7 is an exploded perspective view showing an angle adjusting block and LED modules.
Figure 8:
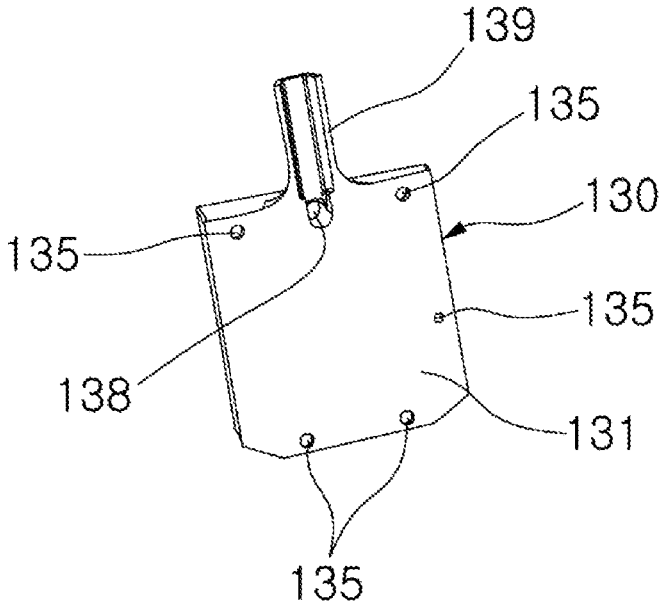
FIG. 8 is a perspective view showing the rear surface of an angle adjusting block.

Referring to FIGS. 7 and 8, the plurality of light source blocks 130 includes the angle adjusting block 131 and the plurality of LED modules 140 installed on the angle adjusting block 131.

The angle adjusting block 131 is formed of a metal material that is the same as that of the housing 110, preferably a metal having excellent heat conductivity such as aluminum or aluminum alloy, considering heat transfer and hardness and can be manufactured in a pressure or die-casting method.

The angle adjusting block 131 is roughly formed in a hexahedron having a rectangular or square shape depending on the number of LED modules 140 installed on the front side, and a duct unit 139 is predominantly formed on the top surface of the angle adjusting block.

In addition, a plurality of fixing holes 135 is formed, for example, at the four corners of the angle adjusting block in order to fixedly install the angle adjusting block 131 on the mounting surface 112 of the housing 110 using the fixing pieces 145. Multi-step inclined surfaces 133*a* and 133*b* for installing the plurality of LED modules 140 at a certain angle are formed on the front side of the angle adjusting block 131 so that the lighting apparatus 100 may illuminate with a desired light distribution characteristic. In this case, the multi-step inclined surfaces 133*a* and 133*b* are formed to have one or more steps depending on the positions of the angle adjusting blocks 131 installed on the plurality of mounting surfaces 112.

In addition, a wire insertion hole 138 passing through from the front to the rear is formed on the plurality of angle adjusting blocks 131, and the duct unit 139 is extendedly formed at one side of the angle adjusting block 131 to guide a wire 148 drawn out from the installed LED module 140 and inserted into the wire insertion hole 138 toward the PCB 150, so that a plurality of wires 148 can be arranged without being exposed to outside. The duct unit 139 can be formed to have a slightly different length depending on the installation position of the angle adjusting block 131 (refer to FIG. 6).

In this case, a connector pin not shown in the figure is installed at the front end of the plurality of wires 148, and wiring can be accomplished in a method of inserting the connector pin into a connector housing installed on the PCB 150.

The plurality of LED modules 140 includes a metal PCB 141 having a roughly rectangular shape and a plurality of LEDs 143 installed on the outer surface of the metal PCB 141. The metal PCB 141 is preferably formed of a board of a material having excellent heat conductivity (e.g., aluminum, copper, iron, or alloy of these) and fixed to the inclined surfaces 133*a* and 133*b* of the angle adjusting block 131 using certain fixing pieces 145. In this case, penetrating holes 147 for passing through the fixing pieces 145 are formed on the metal PCB 141, and connection holes 137 for receiving the fixing pieces 145 are formed on the inclined surfaces 133*a* and 133*b*.

Referring to FIGS. 2 and 6 again, the protection cover 160, the packing unit 170, and the fixing ring 180 for sealing the front side of the lighting apparatus 100 will be descried respectively.

Figure 9:
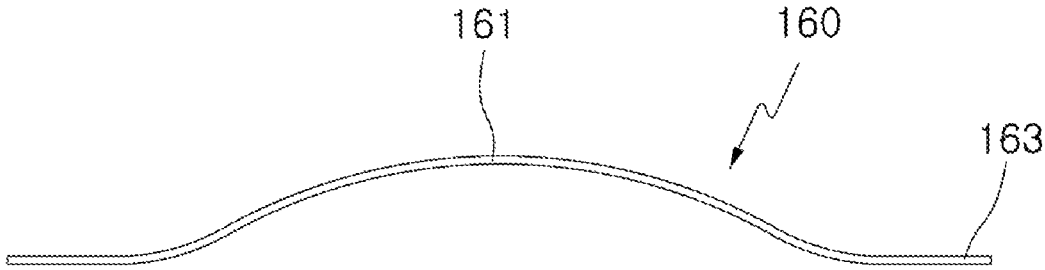
FIG. 9 is a cross-sectional view showing a protection cover.
Figure 10:
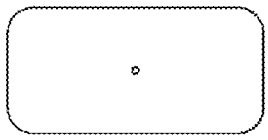
FIG. 10 Prior Art
FIG. 10 is a view showing a light distribution curve of each light distribution type.
Figure 10:
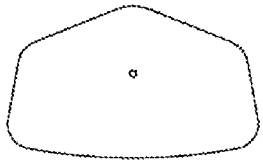
FIG. 10 Prior Art
Figure 10:
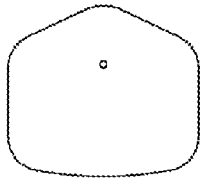
FIG. 10 Prior Art
Figure 10:
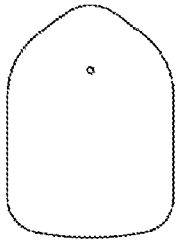
FIG. 10 Prior Art
Figure 10:
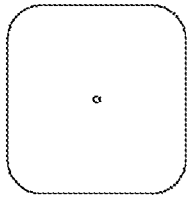
FIG. 10 Prior Art

The protection cover 160 is installed at the opening of the housing 110 to prevent foreign materials or moisture from flowing into the housing 110 and formed of a transparent or semi-transparent glass or synthetic resin material. As shown in FIG. 9, the protection cover 160 includes a convex portion 161 slightly and slowly protruding upward as it approaches to the center portion. Curvature of the convex portion 161 is preferably determined considering total reflection and penetration of light emitted from the plurality of LEDs 143. If the convex portion 161 is provided at the protection cover 160 as described above, transmittance can be improved by 6% or more compared with a flat-type cover.

In addition, since the convex portion 161 is recessed into the housing 110 when the protection cover 160 is mounted on the housing 110, volume of the lighting apparatus can be reduced compared with conventional light apparatuses in which a protection cover inflatingly protrudes toward outside.

The packing unit 170 is formed of a ring-shaped rubber material, and an insertion groove 171 for receiving an outer circumferential end 163 of the protection cover 160 is formed along the inner circumference. In addition, a plurality of sealing projections 173 is formed along the external circumference of the packing unit 170, and the plurality of sealing projections 173 contacts with the housing 110 and the fixing ring 180 to improve sealing capability.

The fixing ring 180 is formed in a ring shape in order to fix the protection cover 160 to the housing 110 and has a diameter roughly corresponding to the lower portion of the housing 110. The fixing ring 180 is preferably formed of an aluminum material like the housing 110. The fixing ring 180 is provided with a coupling projection 182 combined with a coupling groove 118 formed along the lower portion of the housing 110 in order to improve capability of coupling with the housing 110, and the fixing ring 180 is fixedly installed in the housing 110 by a plurality of fixing pieces 185. Accordingly, the fixing ring 180 presses and fixes the packing unit 170 and the protection cover 160 to the housing 110 by a supporting latch 181. In this case, a plurality of penetrating holes 183 through which the plurality of fixing pieces 185 passes is formed at the fixing ring 180, and a plurality of connection holes 119 for receiving the fixing pieces 185 is formed at the housing 110.

The lighting apparatus using LEDs according to an embodiment of the present invention can implement a variety of light distribution types, e.g., the second to fifth light distribution types, by diversely modifying combination of the angle adjusting blocks 131 having LED modules 140 inside the housing 110, and thus the degree of freedom of design is enhanced when various types of lighting apparatuses are designed.

In addition, since each of wires 148 drawn out from a plurality of LED modules 140 passes through the duct unit 139 of the angle adjusting block 131, the wires are prevented from being disorderly arranged inside the housing 110. Therefore, the plurality of wires 148 is maintained to be orderly arranged, and thus it is easy to perform maintenance, and efficiency of work can be improved.

Furthermore, workability can be enhanced since weight of the housing 110 is reduced by forming a plurality of cooling fins 113 on the outer side surface and the top surface of the housing 110 in the radial direction, and at the same time, cooling efficiency can be improved by expanding the surface area of the cooling fins 113 formed on the housing 110.

In addition, light transmittance is maximized and overall volume can be reduced by depressing the protection cover 160 toward inside at slow curvature, and thus it is easy to carry the lighting apparatus, and the lighting apparatus can be easily stored while the protection cover is assembled into the housing 110.

Furthermore, water can be prevented by the packing unit 170 installed along the outer circumference of the protection cover 160, and particularly, sealing capability can be improved owing to a plurality of sealing projections 173 formed on the packing unit 170.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The lighting apparatus of the present invention is applied to street lamps for illuminating roads, indoor lamps, lamps installed in a parking lot, and the like of various light distribution types.

What is claimed is:

1. A lighting apparatus using light-emitting diodes (LEDs), the apparatus comprising:

a housing in which an inner side surface is partitioned into a plurality of mounting surfaces and a plurality of cooling fins is prominently formed on an outer side surface;

a plurality of light source blocks while at least one provided with a plurality of LED modules on an outer surface of a plurality of angle adjusting blocks having multi-step inclined surfaces, the plurality of light source blocks mounted at positions selectively determined on the plurality of mounting surfaces of the housing so that light emitted from the LED modules can implement a predetermined light distribution type; and a protection cover for covering a lower portion of the housing.

2. The apparatus according to claim 1, wherein the cooling fins of the housing are arranged in a radial shape to be spaced at regular intervals.

3. The apparatus according to claim 1, wherein a horizontal cross section of the housing is any one of polygons including a circle, an oval, a rectangle, and a square.

4. The apparatus according to claim 1, wherein the angle adjusting block includes:

a penetrating hole for guiding a wire drawn out from the LED module to a rear side to pass through the angle adjusting block; and a duct unit extendedly formed at one side of the angle adjusting block, one end of which is communicated with the penetrating hole, for guiding the wire to a printed circuit board.

5. The apparatus according to claim 1, wherein the plurality of cooling fins is arranged to have a relatively thick cooling fin at regular intervals, and connection holes for receiving fixing pieces are formed on an inner side of the relatively thick cooling fin in order to fix the angle adjusting block.

6. The apparatus according to claim 1, wherein the protection cover includes a convex portion slowly depressed toward inside the housing as it approaches to a center.

7. The apparatus according to claim 1, further comprising:

a fixing ring for fixedly supporting the protection cover to the housing; and a packing unit installed along an outer circumference of the protection cover, for protecting water between the protection cover and the housing, wherein the packing unit is provided with a plurality of sealing projections along an outer circumference of the packing unit.

8. The apparatus according to claim 1, further comprising a printed circuit board mounted to be spaced apart from an inner top surface of the housing, for supplying power to the LEDs, wherein the printed circuit board is a double side printed circuit board, in which electronic elements are installed on a top surface, and an amber LED module is installed on a bottom surface.

9. The apparatus according to claim 8, wherein a power element installed on the printed circuit board is supported by a spacer arranged between the power element and the top surface of the printed circuit board and contacts with the inner top surface of the housing, thereby dissipating heat.

10. A lighting apparatus using light-emitting diodes, the apparatus comprising:

a housing having an open bottom and provided with a receiving concave, in which an inner side surface of the receiving concave is partitioned into a plurality of mounting surfaces, and a plurality of cooling fins is formed on an outer surface in a radial shape to be spaced at regular intervals;

a plurality of light source blocks with at least one provided with a plurality of LED modules installed on an outer surface of a plurality of angle adjusting blocks, the plurality of light source blocks mounted at positions selectively determined on the plurality of mounting surfaces of the housing so that light emitted from the LED modules can implement a predetermined light distribution type;

a printed circuit module mounted to be spaced apart from an inner top surface of the housing, for supplying power to the LEDs; and a protection cover provided with a convex portion slowly depressed toward inside the housing as it approaches to a center, for covering a lower portion of the housing.

11. The apparatus according to claim 10, wherein a diameter of an outer side surface of the housing increases toward a low portion of the housing.

12. The apparatus according to claim 10, wherein the mounting surface on which the plurality of angle adjusting blocks is installed is formed to have an inclination angle.

13. The apparatus according to claim 10, the angle adjusting block includes:

at least one inclined surface for differentiating radiation angles when the LED modules are mounted;

a penetrating hole for guiding a wire drawn out from the LED module to a rear side to pass through the angle adjusting block; and a duct unit extendedly formed on a top of the angle adjusting block, one end of which is communicated with the penetrating hole, for guiding the wire to a printed circuit board.

* * * * *